US011090895B2

(12) United States Patent
Lai

(10) Patent No.: US 11,090,895 B2
(45) Date of Patent: Aug. 17, 2021

(54) FEEDING DEVICE FOR A BOX FOLDING MACHINE

(71) Applicant: EXPACK INDUSTRIAL CORPORATION, Taichung (TW)

(72) Inventor: Yu-Ting Lai, Taichung (TW)

(73) Assignee: EXPACK INDUSTRIAL CORPORATION, Taichung (TW)

( * ) Notice: Subject to any disclaimer, the term of this patent is extended or adjusted under 35 U.S.C. 154(b) by 0 days.

(21) Appl. No.: 16/905,288

(22) Filed: Jun. 18, 2020

(65) Prior Publication Data

US 2021/0070004 A1 Mar. 11, 2021

(30) Foreign Application Priority Data

Sep. 6, 2019 (TW) ..... 108211909

(51) Int. Cl.
*B31B 50/04* (2017.01)
*B31B 50/07* (2017.01)
*B31B 120/30* (2017.01)

(52) U.S. Cl.
CPC ..... *B31B 50/042* (2017.08); *B31B 50/07* (2017.08); *B31B 2120/302* (2017.08)

(58) Field of Classification Search
CPC ..... B31B 50/00; B31B 50/02; B31B 50/042; B31B 50/046; B31B 50/06; B31B 50/062; B31B 50/064; B31B 50/066; B31B 50/07; B31B 50/788; B31B 50/262; B31B 2120/00; B31B 2120/30; B31B 2120/302; B65B 43/10; B65B 43/14; B65B 70/20
USPC ..... 493/124, 126, 130, 135, 182, 201, 316, 493/416
See application file for complete search history.

(56) References Cited

U.S. PATENT DOCUMENTS 6,913,568 B2 * 7/2005 Frank ..... B31B 50/80 493/309
7,131,941 B2 * 11/2006 Makar ..... 493/309
2012/0324833 A1 * 12/2012 Koch ..... B65B 49/12 53/452
2015/0031517 A1 * 1/2015 Cavazza ..... B65B 43/185 493/124
2015/0072847 A1 * 3/2015 Graham ..... B31B 50/30 493/130
2015/0360801 A1 * 12/2015 Sytema ..... B65B 43/10 53/74
2016/0159026 A1 * 6/2016 Porteous ..... B65G 59/068 493/126

(Continued)

*Primary Examiner* — Hemant Desai
*Assistant Examiner* — Jacob A Smith
(74) *Attorney, Agent, or Firm* — Birch, Stewart, Kolasch & Birch LLP

(57) ABSTRACT

A feeding device is adapted to be installed to a box folding machine for delivering a plurality of unfolded cardboard boxes, and includes a base unit, a positioning unit and a box pushing unit. The base unit is operable for moving the cardboard boxes to push two stopping members of the positioning unit to rotate from a stopping position, where the cardboard boxes are retained between upstream and downstream ends of the base unit, to a releasing position, where one of the cardboard boxes is moved out of the downstream end to a standby position. The box pushing unit is operable to push the one of the cardboard boxes from the standby position to a ready-to-fold position, where the one of the cardboard boxes is ready to be folded.

8 Claims, 9 Drawing Sheets

(56) References Cited

U.S. PATENT DOCUMENTS

| | | | | |
|---|---|---|---|---|
| 2016/0185065 | A1* | 6/2016 | Sytema | B31B 50/52<br>493/180 |
| 2019/0263545 | A1* | 8/2019 | Yokota | B65B 35/30 |
| 2019/0283356 | A1* | 9/2019 | Desertot | B31B 50/00 |

* cited by examiner

FEEDING DEVICE FOR A BOX FOLDING MACHINE

CROSS-REFERENCE TO RELATED APPLICATION

This application claims priority of Taiwanese Patent Application No. 108211909, filed on Sep. 6, 2019.

FIELD

The disclosure relates to an automatic box folding machine, and more particularly to a feeding device of a box folding machine that feeds unfolded cardboard boxes.

BACKGROUND

A conventional cardboard box folding machine disclosed in Taiwanese Utility Model Patent No. M502640 includes a machine body, a box storing unit and a box pushing mechanism.

The box storing unit is mounted to an end of the machine body for holding unfolded cardboard boxes that are stacked vertically. The box pushing mechanism is mounted under the center of the box storing unit, and includes a supporting drive and a supporting member that is connected to the supporting driver. The supporting driver is operable to drive the supporting member to provide support for the cardboard boxes, preventing the cardboard boxes from being deformed by their own weight, especially for large-sized cardboard boxes.

During operation, the unfolded cardboard boxes are stored in the box storing unit to be fed to the machine body to be folded by a box folding device of the cardboard box folding machine.

SUMMARY

The object of the disclosure is to provide a feeding device that can position and feed the unfolded cardboard boxes one by one for facilitating the box folding process.

According to the disclosure, the feeding device is adapted to be installed to a box folding machine for delivering a plurality of unfolded cardboard boxes.

The feeding device includes a base unit, a positioning unit and a box pushing unit.

The base unit includes a machine body, a conveyor group and a support group.

The machine body has top and bottom surfaces and a side surface. The top and bottom surfaces are opposite to each other along a vertical direction, and extend from an upstream end of the machine body to a downstream end of the machine body along a first horizontal direction which is perpendicular to the vertical direction. The side surface is formed at the downstream end, and extends between and is perpendicular to the top and bottom surfaces.

The conveyor group is mounted to the top surface of the machine body for conveying the cardboard boxes along the first horizontal direction.

The support group is mounted to the machine body, and has a support surface that is connected perpendicularly to the side surface of the machine body, and that extends between and is parallel to the top and bottom surfaces of the machine body.

The positioning unit includes two stopping members and two first springs.

The stopping members are mounted rotatably to the downstream end of the machine body, and are spaced apart in a second horizontal direction perpendicular to the first horizontal direction and the vertical direction.

The conveyor group is operable for moving the cardboard boxes to push the stopping members to rotate from a stopping position, where the cardboard boxes are retained between the upstream and downstream ends of the machine body, to a releasing position, where one of the cardboard boxes is moved out of the downstream end of the machine body to a standby position to be clamped between the stopping members and the remainder of the cardboard boxes.

Each of the first springs is connected between a respective one of the stopping members and the machine body for biasing the respective one of the stopping members toward the stopping position.

The box pushing unit including a frame member, a drive group, a mounting seat and at least one pushing group.

The frame member is mounted to the downstream end of the machine body. The mounting seat is mounted to the frame member and is movable along the vertical direction relative to the machine body. The drive group is connected to the frame member for driving the movement of the mounting seat along the vertical direction.

The at least one pushing group is co-movably mounted to the mounting seat such that the movement of the mounting seat along the vertical direction moves the at least one pushing group to push the one of the cardboard boxes along the vertical direction from the standby position to a ready-to-fold position, where the one of the cardboard boxes abuts against the support surface of the support group.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
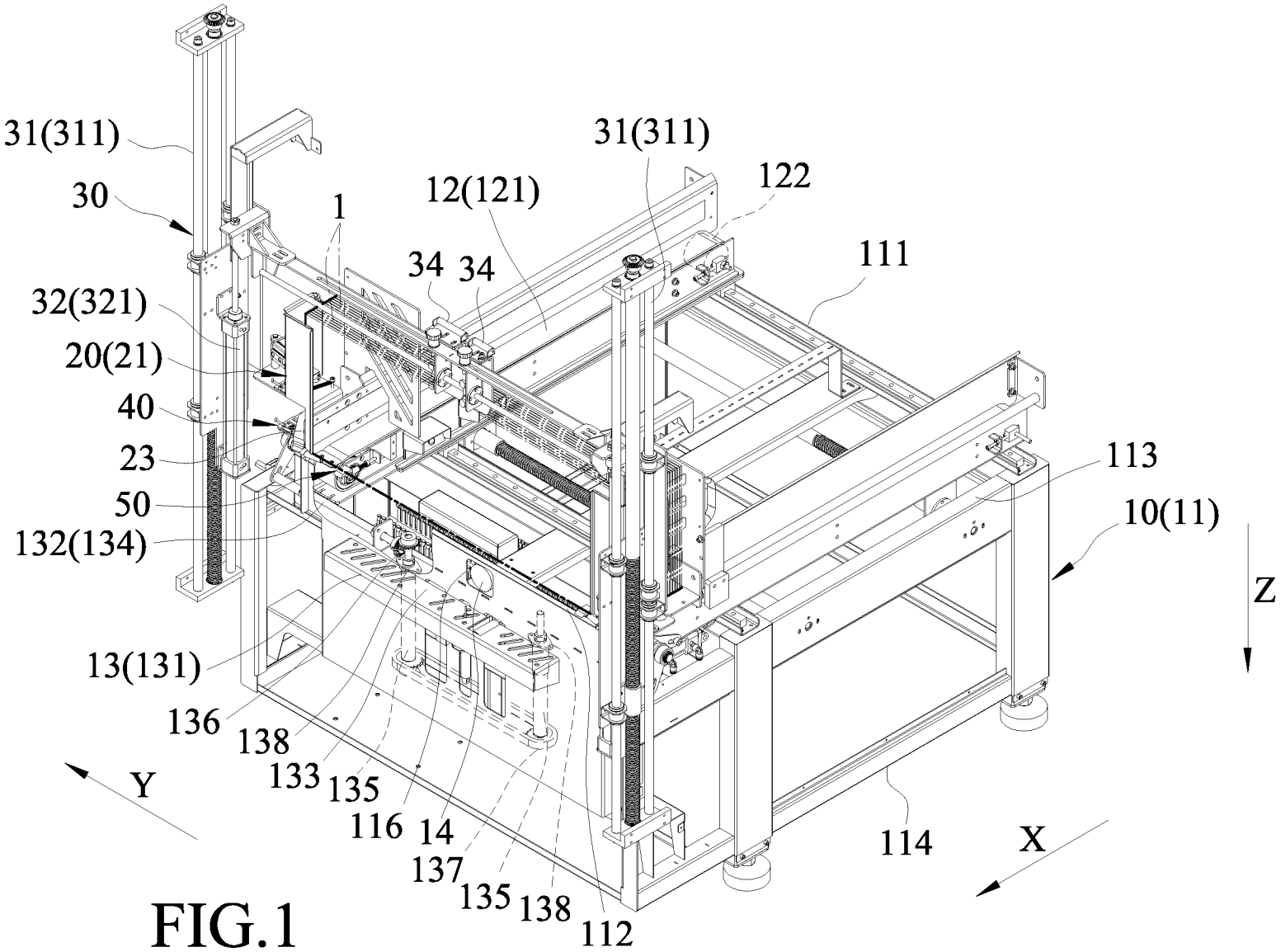
FIG. 1 is a perspective view of an embodiment of a feeding device according the disclosure.
Figure 2:
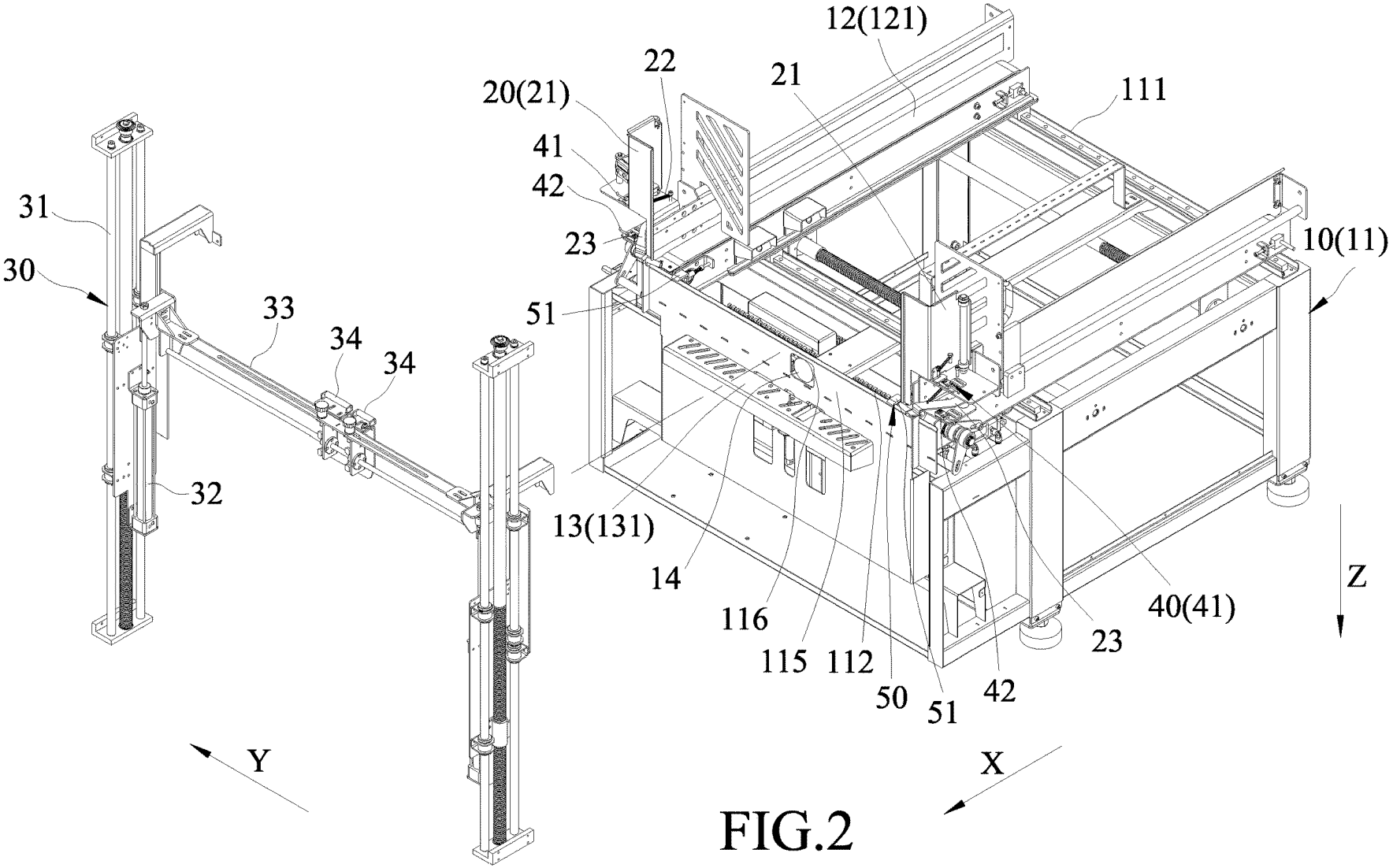
FIG. 2 is a partially exploded perspective view of the embodiment.
Figure 3:
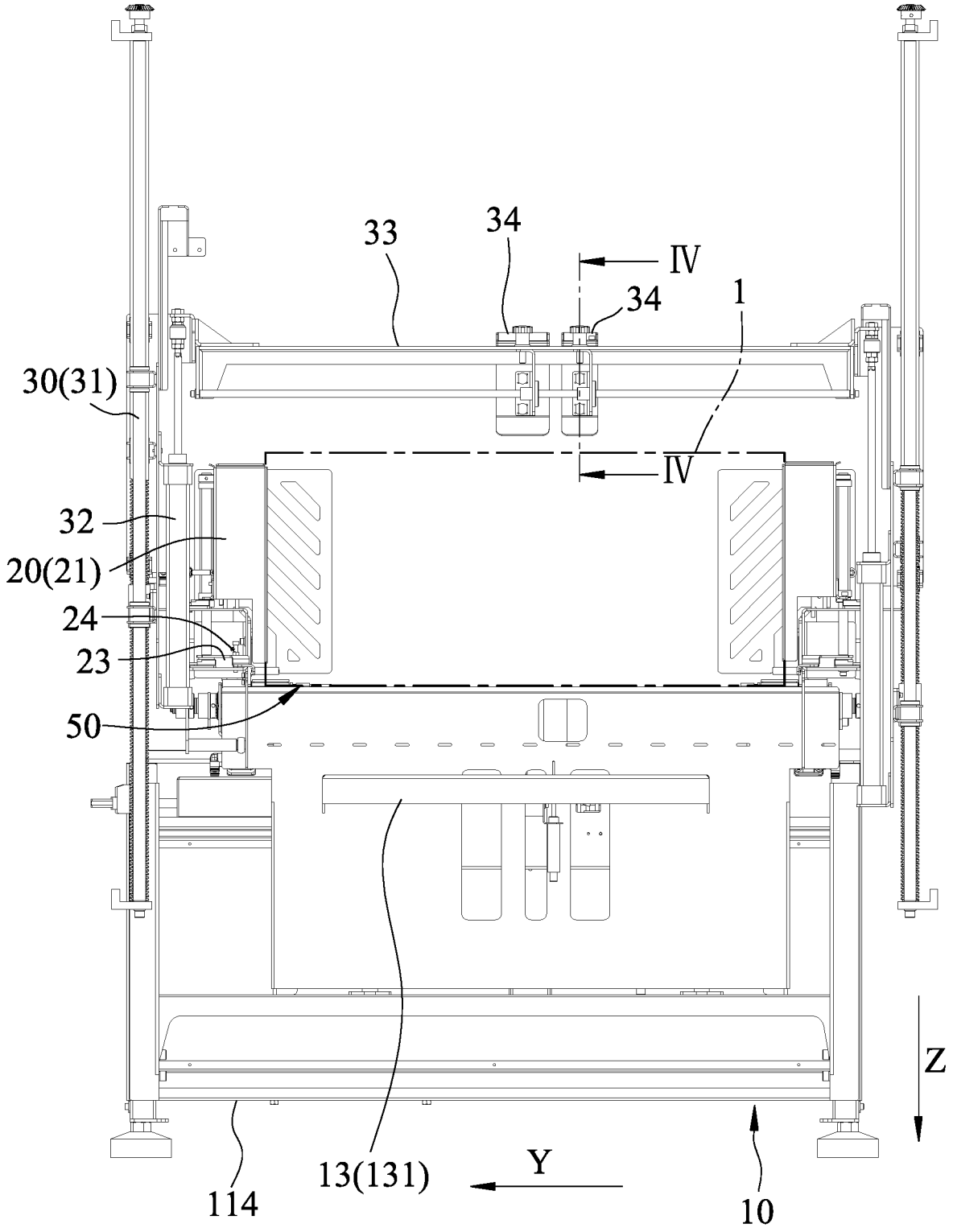
FIG. 3 is a side view of the embodiment.

Referring to FIGS. 1 to 3, an embodiment of a feeding device is adapted to be installed to a box folding machine for delivering a plurality of unfolded cardboard boxes 1. The feeding device includes a base unit 10, a positioning unit 20, a box pushing unit 30, a sensor unit 40 and an assisting unit 50.

The base unit 10 includes a machine body 11, a conveyor group 12, a support group 13 and a vacuum suction member 14.

The machine body 11 has a top surface 113, a bottom surface 114, and a side surface 115. The top and bottom surfaces 113, 114 are opposite to each other along a vertical direction (Z), and extend from an upstream end 111 of the machine body 11 to a downstream end 112 of the machine body 11 along a first horizontal direction (X) which is perpendicular to the vertical direction (Z). The side surface 115 is formed at the downstream end 112 of the machine body 11, extends between and is perpendicular to the top and bottom surfaces 113, 114, and is formed with a through hole 116.

The vacuum suction member 14 is mounted to the machine body 11, is exposed from the through hole 116 of the side surface 115, and is connected to a vacuuming unit (not shown).

The conveyor group 12 is mounted to the top surface 113 of the machine body 11, and includes two conveyor belts 121 (only one is visible in FIGS. 1 and 2, and the other one is visible in FIGS. 8 and 9) that are spaced apart in a second horizontal direction (Y) perpendicular to the first horizontal direction (X) and the vertical direction (Z), and a plurality of pulleys 122 (only one is visible in FIG. 1). The conveyor belts 121 are trained on the pulleys 122 and are adapted for conveying the cardboard boxes 1 along the first horizontal direction (X).

The support group 13 is mounted to the machine body 11, and includes a support seat 131 and a seat adjustment driver 132.

The support seat 131 of the support group 13 is movable along directions parallel to the vertical direction (Z) relative to the machine body 11, and has a support surface 133. The support surface 133 is connected perpendicularly to the side surface 115 of the machine body 11, and extends between and is parallel to the top and bottom surfaces 113, 114 of the machine body 11. The vacuum suction member 14 of the machine body 11 is disposed between the support surface 133 and the top surface 113 of the machine body 11.

The seat adjustment driver 132 of the support group 13 is connected to the support seat 131 for driving movement of the support seat 131 parallel to the vertical direction (Z) relative to the machine body 11 so as to adjust a distance between the support surface 133 and the top surface 113 of the machine body 11, in order to fit various sizes of the cardboard boxes 1.

Specifically, the seat adjustment driver 132 includes a drive shaft 134, two parallel threaded shafts 135, a bevel gear group 136, a transmission gear group 137 and two nut pieces 138.

The drive shaft 134 extends transversely to the vertical direction (Z), and is rotatably mounted to the machine body 11. The threaded shafts 135 extend along the vertical direction (Z), and are rotatably mounted to the machine body 11.

The bevel gear group 136 is mounted between the drive shaft 134 and one of the threaded shafts 135 for transferring rotation of the drive shaft 134 to rotation of the one of the threaded shafts 135. The transmission gear group 137 is mounted between the threaded shafts 135 for transferring rotation of the one of the threaded rods 135 to the other one of the threaded rods 135 such that the threaded shafts 135 rotate at the same speed.

Each of the nut pieces 138 is connected to the support seat 131, and is threadedly and movably engaged with a respective one of the threaded shafts 135 such that, when the threaded shafts 135 rotate, the nut pieces 138 and the support seat 131 move collectively along the directions parallel to the vertical direction (Z) relative to the machine body 11.

Figure 7:
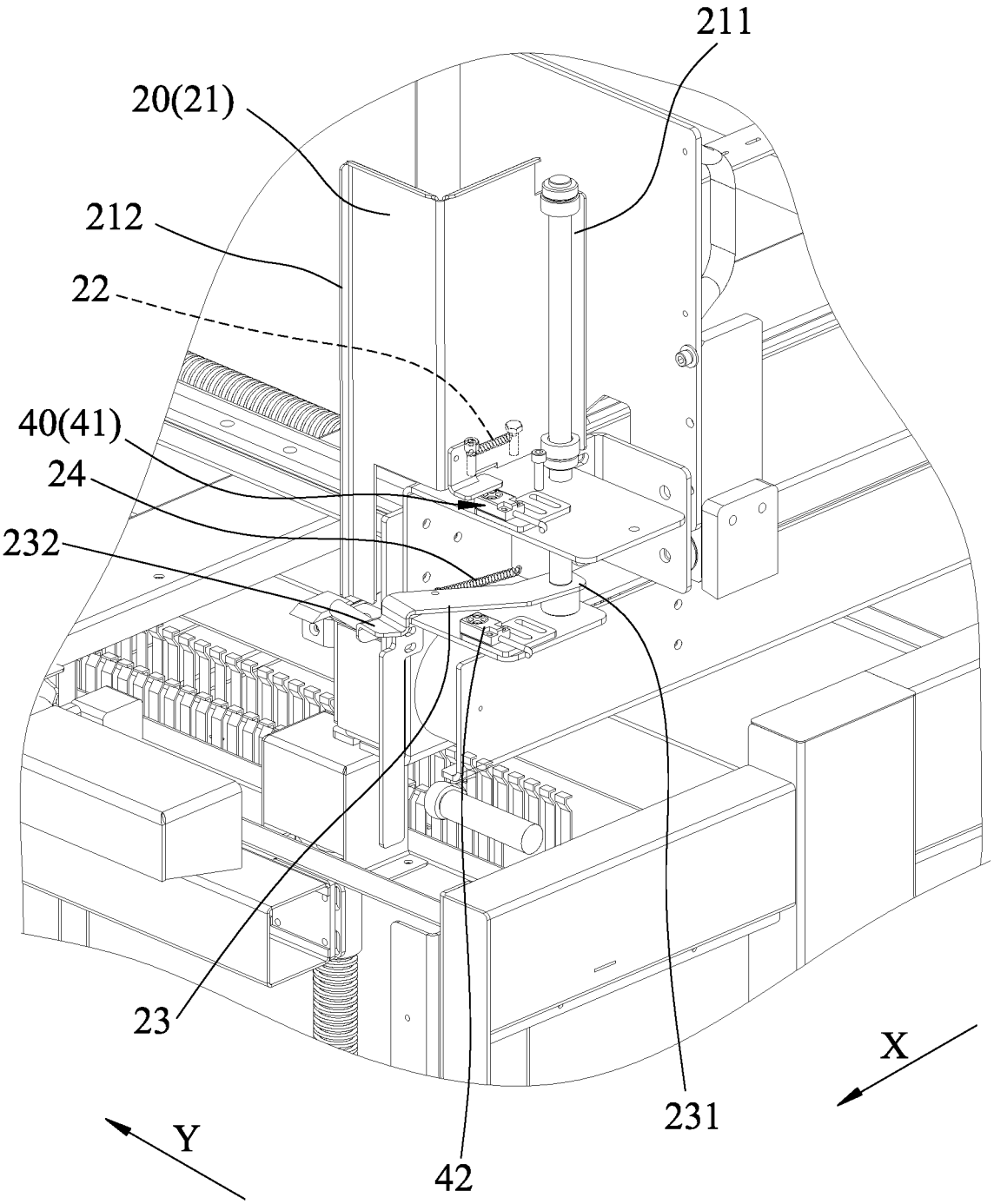
FIG. 7 is another fragmentary perspective view of the embodiment.
Figure 8:
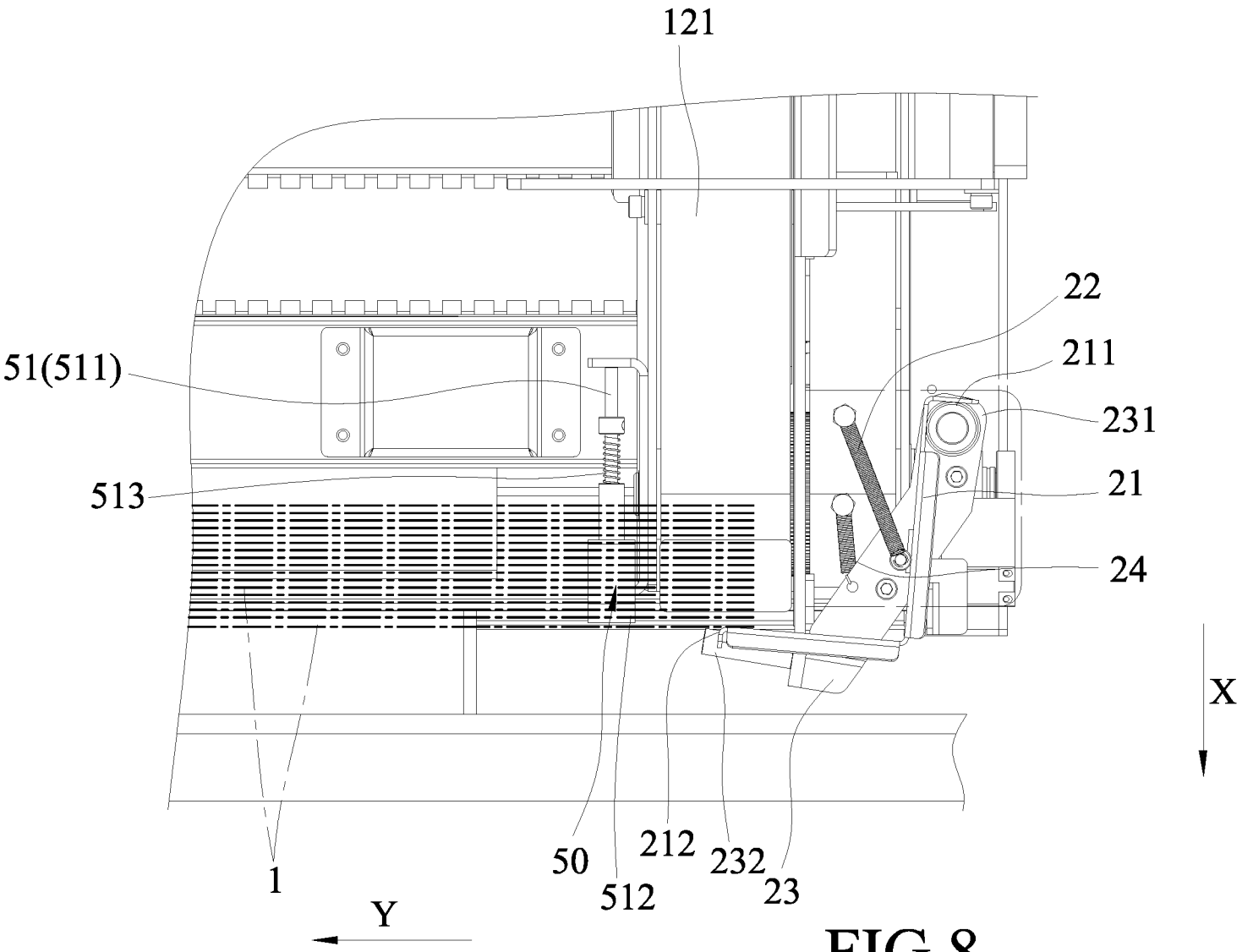
FIG. 8 is a fragmentary top view of the embodiment, illustrating a stopping member at a stopping position.
Figure 9:
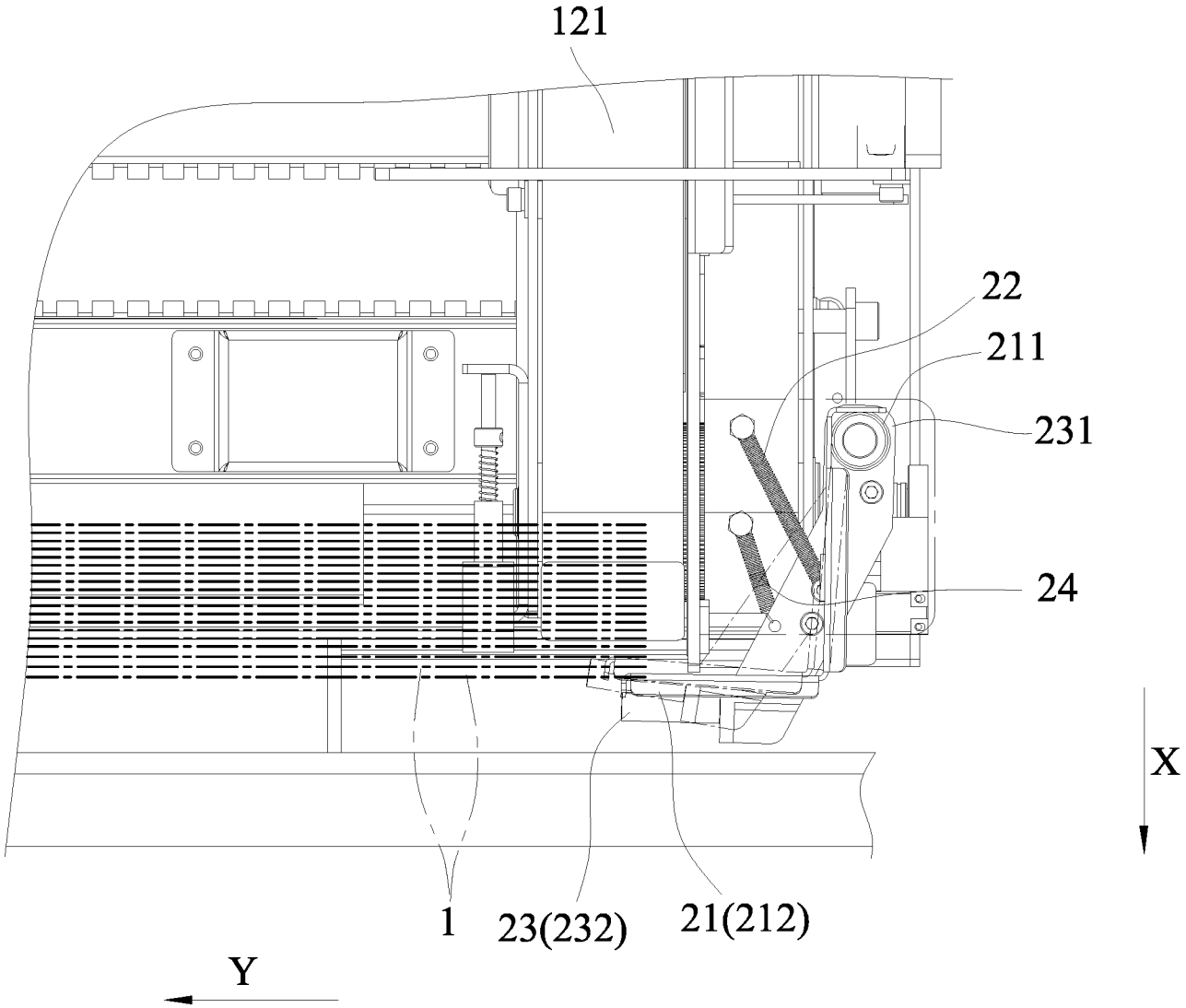
FIG. 9 is another fragmentary top view of the embodiment, illustrating the stopping member at a releasing position.

Referring further to FIGS. 7 to 9, the positioning unit 20 includes two stopping members 21, two first springs 22, two blocking members 23 and two second springs 24.

The stopping members 21 are mounted rotatably to the downstream end 112 of the machine body 11, and are spaced apart in the second horizontal direction (Y). Each of the stopping members 21 has a pivot portion 211 that is rotatably connected to the machine body 11 to serve as a pivot, and a swing portion 212 that is co-rotatably connected to the pivot portion 211, and that has an L-shaped structure.

The conveyor group 12 of the base unit 10 is operable for moving the cardboard boxes 1 to push the stopping members 21 to rotate from a stopping position (see FIG. 8), where the cardboard boxes 1 are retained between the upstream and downstream ends 111, 112 of the machine body 11, to a releasing position (see FIG. 9), where one of the cardboard boxes 1 (i.e. the outermost one proximate to the downstream end 112 of the machine body 11) is moved out of the downstream end 112 of the machine body 11 to a standby position to be clamped between the stopping members 21 and the remainder of the cardboard boxes 1.

Each of the first springs 22 is connected between a respective one of the stopping members 21 and the machine body 11 for biasing the respective one of the stopping members 21 toward the stopping position.

The blocking members 23 are mounted rotatably to the downstream end 112 of the machine body 11, and are spaced apart in the second horizontal direction (Y). Each of the blocking members 23 has a pivot segment 231 that is rotatably connected to the machine body 11 to serve as a pivot, and a swing segment 232 that is co-rotatably connected to the pivot segment 231.

The blocking members 23 are adapted to be pushed by the one of the cardboard boxes 1 to rotate during rotation of the stopping members 21 from the stopping position to the releasing position, such that the stopping members 21, the blocking members 23 and the remainder of the cardboard boxes 1 cooperatively hold the one of the cardboard boxes 1 to be perpendicular to the first horizontal direction (X) at the standby position.

Each of the second springs 24 is connected between a respective one of the blocking members 23 and the machine body 11, and is adapted to bias the respective one of the blocking members 23 against the one of the cardboard boxes 1.

Figure 4:
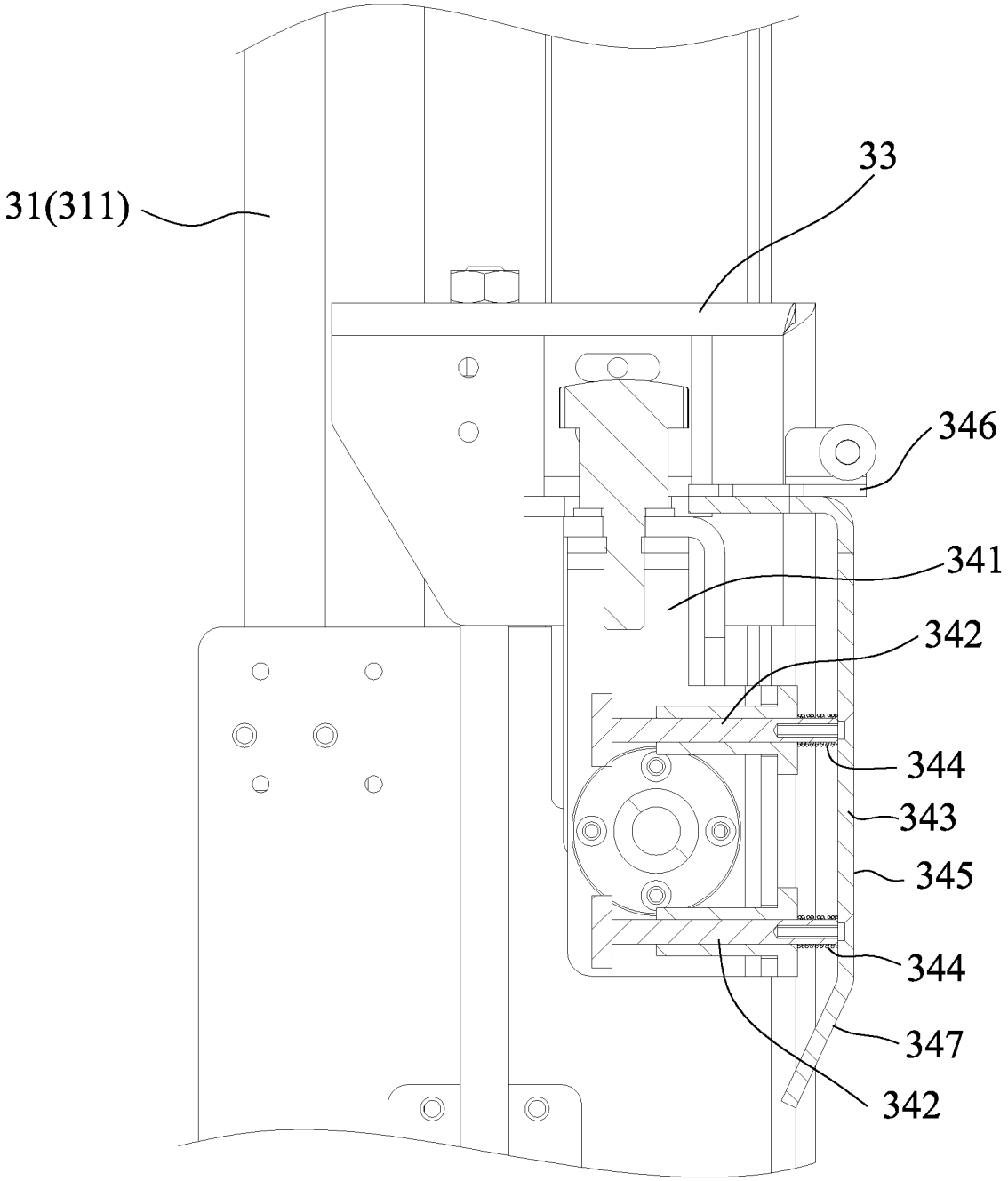
FIG. 4 is a fragmentary sectional view taken along line IV-IV in FIG. 3.
Figure 5:
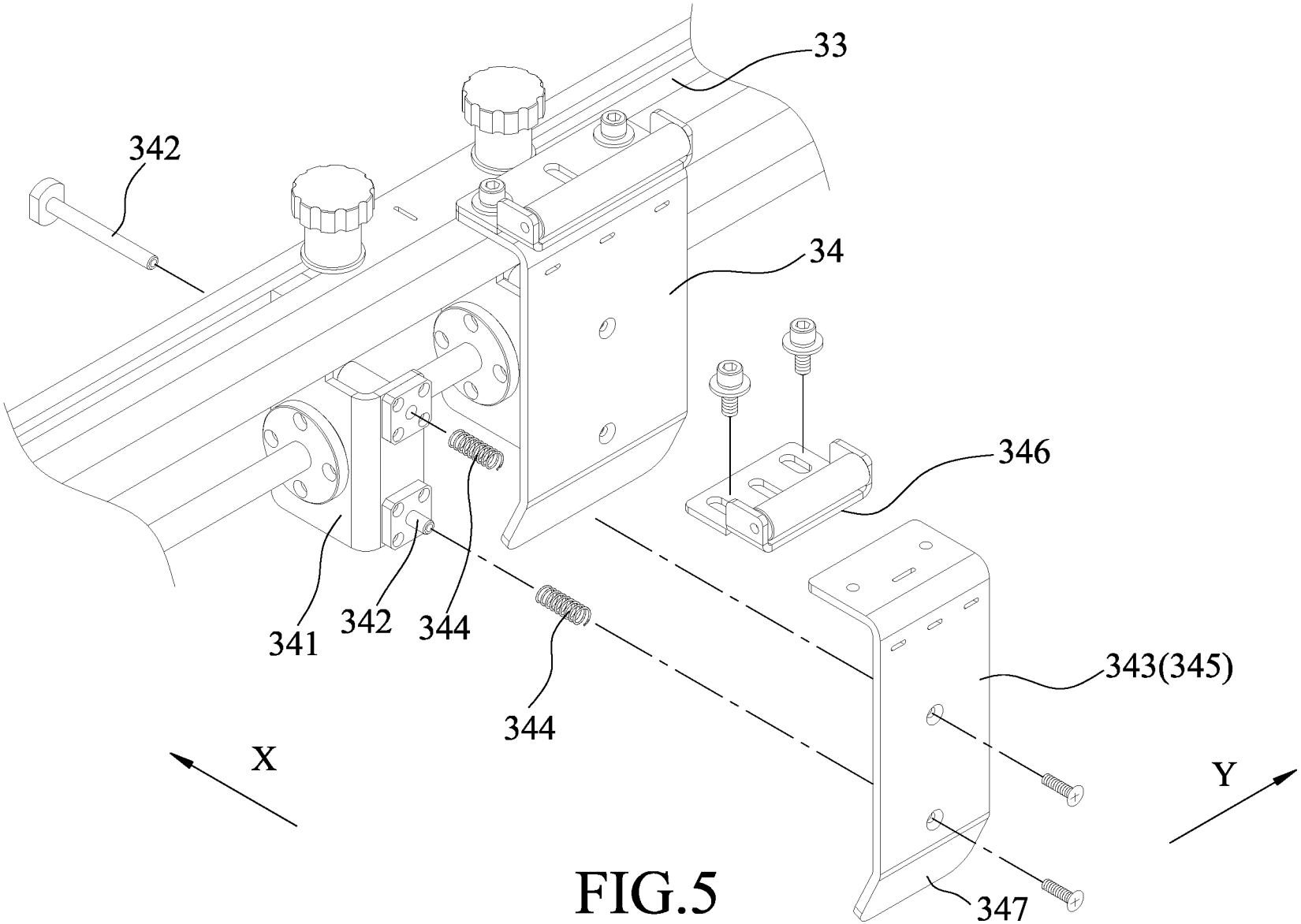
FIG. 5 is a partially exploded and fragmentary perspective view, illustrating two pushing groups of a box pushing unit of the embodiment.

Referring back to FIGS. 1 to 3, and further referring to FIGS. 4 and 5, in this embodiment, the box pushing unit 30 includes a frame member 31, a drive group 32, a mounting seat 33 and two pushing groups 34.

The frame member 31 is mounted to the downstream end 112 of the machine body 11, and has two guide portions 311 that extend along the vertical direction (Z), and that are spaced apart along the second horizontal direction (Y).

The mounting seat 33 extends along the second horizontal direction (Y), is mounted to and between the guide portions 311 of the frame member 31, and is movable along the vertical direction (Z) relative to the machine body 11.

The drive group 32 includes two drive cylinders 321 that are connected respectively to the guide portions 311 of the frame member 31 for driving the movement of the mounting seat 33 along the vertical direction (Z).

The pushing groups 34 are co-movably mounted to the mounting seat 33 such that the movement of the mounting seat 33 along the vertical direction (Z) moves the pushing groups 34 to push the one of the cardboard boxes 1 along the vertical direction (Z) from the standby position to a ready-to-fold position, where the one of the cardboard boxes 1 abuts against the support surface 133 of the support group 13 of the base unit 10.

When the one of the cardboard boxes 1 is at the ready-to-fold position, the vacuum suction member 14 of the base unit 10 is adapted for pulling the one of the cardboard boxes 1 against the side surface 115 via negative pressure.

Each of the pushing groups 34 includes a linking block 341, two pins 342, a push component 343 and two resilient members 344.

The linking block 341 is connected to the mounting seat 33. Each of the pins 342 extends movably along the first horizontal direction (X) through the linking block 341 with an end segment thereof protruding out of the linking block 341. The resilient members 344 are sleeved respectively on the end segments of the pins 342.

The push component 343 has a contact board 345 and a pusher 346. The contact board 345 is spaced apart from the linking block 341 and is connected co-movably to the end segments of the pins 342. Each of the resilient members 344 has opposite ends that abut respectively against the linking block 341 and the contact board 345 for biasing the contact board 345 away from the linking block 341.

The contact board 345 has a slanted end portion 347; the pusher 346 is connected to an end of the contact board 345 opposite to the slanted end portion 347 of the contact board 345.

When the one of the cardboard boxes 1 is at the standby position, the movement of the pushing groups 34 along the vertical direction (Z) moves the contact board 345 of the push component 343 to be in contact with the one of the cardboard boxes 1 under guidance of the slanted end portion 347 of the contact board 345, and moves the pusher 346 to abut against the one of cardboard boxes 1.

Figure 6:
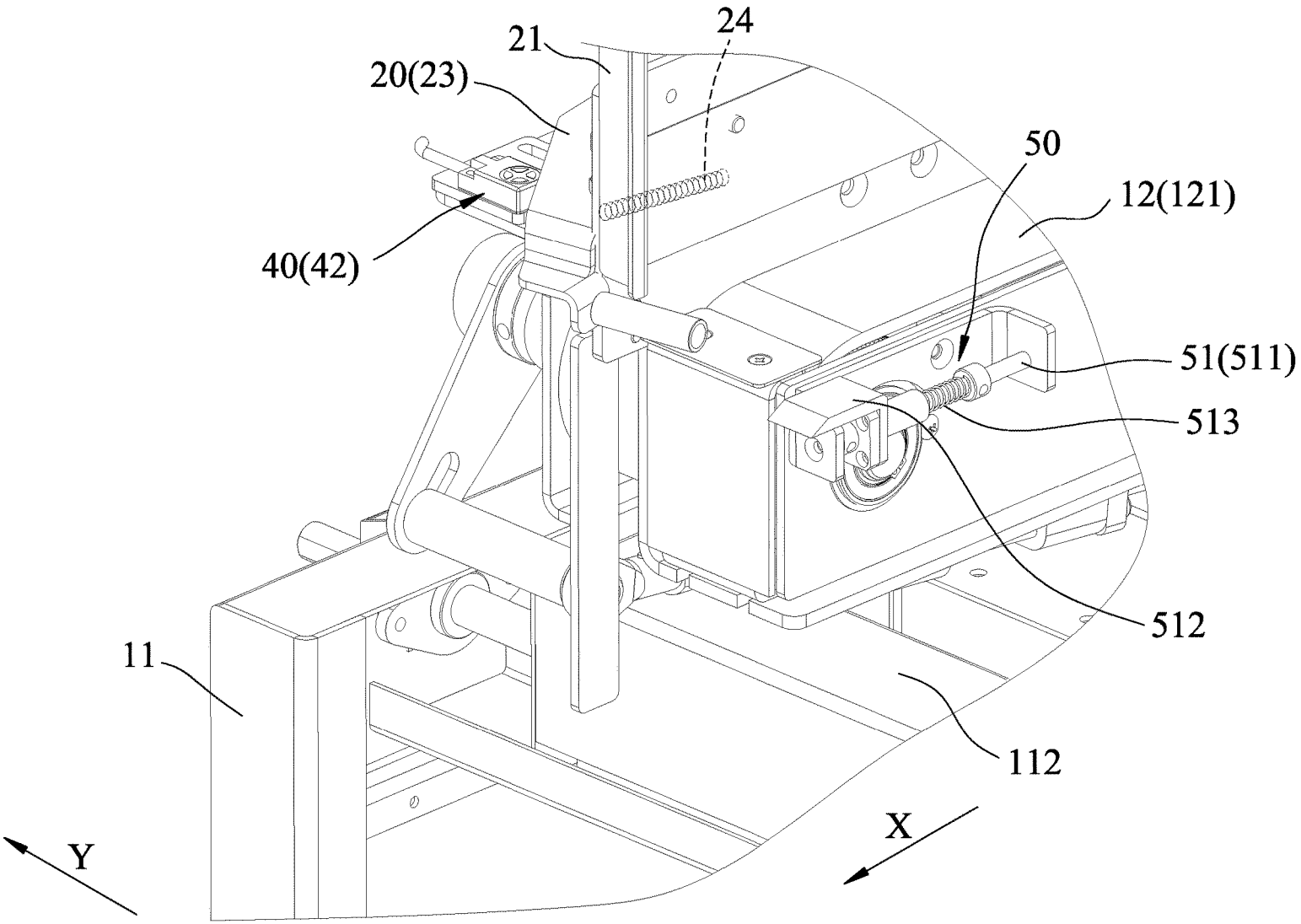
FIG. 6 is a fragmentary perspective view of the embodiment.

Referring back to FIGS. 1 to 3, and further referring to FIGS. 6 and 7, the sensor unit 40 is mounted to the machine body 11, and includes two first sensors 41 and two second sensors 42.

The first sensors 41 are disposed respectively adjacent to the stopping members 21 for sensing movements of the stopping members 21. The second sensors 42 are disposed respectively adjacent to the blocking members 23 for sensing movements of the blocking members 23, and are adapted to cooperate with the first sensors 41 to determine if the one of the cardboard boxes 1 is perpendicular to the first horizontal direction (X) at the standby position.

The assisting unit 50 is mounted to the downstream end 112 of the machine body 11, and includes two assisting pushers 51 that are spaced apart along the second horizontal direction (Y). Each of the assisting pushers 51 includes a push rod 511, a push block 512 and a push spring 513.

For each of the assisting pushers 51, the push rod 511 extends along the first horizontal direction (X), the push block 512 is movably coupled to the push rod 511, and the push spring 513 is sleeved on the push rod 511 and is adapted for biasing the push block 512 to support the one of the cardboard boxes 1 during the movement of the one of the cardboard boxes 1 from the standby position to the ready-to-fold position.

To provide a thorough understanding of the disclosure, a feeding operation of the feeding device is described as follows.

In the beginning of the operation, the unfolded cardboard boxes 1 are disposed on the conveyor belts 121 of the conveyor group 12. When the conveyor group 12 starts running, the cardboard boxes 1 are moved along the first horizontal direction (X) toward the downstream end 112 of the machine body 11.

When the one of the cardboard boxes 1 (i.e. the outermost one proximate to the downstream ends 111 of the machine body 11) touches the swing portions 212 of the stopping members 21, it starts pushing the stopping members 21, which are at the stopping position, and the blocking members 23 of the positioning unit 20 to rotate, until it reaches the standby position and the stopping members 21 are at the releasing position.

At this time, the first and second sensors 41, 42 of the sensing unit 40 sense positions of the stopping members 21 and the blocking members 23; once the first and second sensors 41, 42 determine that the one of the cardboard boxes 1 is perpendicular to the first horizontal direction (X), they will signal a control unit (not shown) to thereby actuate the box pushing unit 30.

Then, the pushing groups 34 of the box pushing unit 30 are driven to move along the vertical direction (Z) to push the one of the cardboard boxes 1 from the standby position to the ready-to-fold position. During this process, the push block 512 of each of the assisting pushers 51 of the assisting unit 50 abuts against the one of the cardboard boxes 1, via biasing force of the push spring 513 of the assisting pusher 51, to support the one of the cardboard boxes 1 during its movement from the standby position to the ready-to-fold position.

When the one of the cardboard boxes 1 is at the ready-to-fold position, the vacuum suction member 14 of the base unit 10 is driven by the vacuuming unit (not shown) to pull the one of the cardboard boxes 1 against the side surface 115 of the machine body 11, securing the position of the one of the cardboard boxes 1.

Finally, a folding device (not shown) will be actuated to start folding the one of the cardboard boxes 1. It should be noted that, in virtue of the first and second springs 22, 24 of the positioning unit 20, when the one of the cardboard boxes 1 is moved away from the ready-to-fold position by the folding device, the stopping and blocking members 21, 23 that are rotated outwardly (i.e. away from the releasing position) by the one of the cardboard boxes 1 will restore back to the stopping position by the first and second springs 22, 24, to abut against the next one of the cardboard boxes 1.

In sum, the feeding device of the present embodiment of the disclosure has advantages as follows.

In virtue of the support seat 131 being adjustable, the feeding device of the present embodiment is able to work with different sizes of cardboard boxes.

In addition, the vacuum suction member 14 is mounted in the through hole 116 of the machine body 11 without protruding thereout, and thus does not obstruct movement of the one of the cardboard boxes 1, as well as the box feeding process.

Finally, with incorporation of the first and second sensors 41, 42 of the sensor unit 40, the pushing groups 34 of the box pushing unit 30 and the assisting unit 50, the one of the cardboard boxes 1 is always ensured to be properly positioned at the standby position, and to have a smooth transition from the standby position to the ready-to-fold position.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A feeding device adapted to be installed to a box folding machine for delivering a plurality of unfolded cardboard boxes, said feeding device comprising:

a base unit including a machine body that has top and bottom surfaces being opposite to each other along a vertical direction and extending from an upstream end of said machine body to a downstream end of said machine body along a first horizontal direction which is perpendicular to the vertical direction, and a side surface formed at said downstream end, and extending between and being perpendicular to said top and bottom surfaces, a conveyor group that is mounted to said top surface of said machine body for conveying the cardboard boxes along the first horizontal direction, and a support group that is mounted to said machine body, and that has a support surface connected perpendicularly to said side surface of said machine body, and extending between and being parallel to said top and bottom surfaces of said machine body;

a positioning unit including two stopping members that are mounted rotatably to said downstream end of said machine body, and that are spaced apart in a second horizontal direction perpendicular to the first horizontal direction and the vertical direction, said conveyor group being operable for moving the cardboard boxes to push said stopping members to rotate from a stopping position, where the cardboard boxes are retained between said upstream and downstream ends of said machine body, to a releasing position, where one of the cardboard boxes is moved out of said downstream end of said machine body to a standby position to be clamped between said stopping members and the remainder of the cardboard boxes, and two first springs, each of said first springs being connected between a respective one of said stopping members and said machine body for biasing said respective one of said stopping members toward the stopping position; and a box pushing unit including a frame member that is mounted to said downstream end of said machine body, a mounting seat that is mounted to said frame member and that is movable along the vertical direction relative to said machine body, a drive group that is connected to said frame member for driving the movement of said mounting seat along the vertical direction, and at least one pushing group that is co-movably mounted to said mounting seat such that the movement of said mounting seat along the vertical direction moves said at least one pushing group to push the one of the cardboard boxes along the vertical direction from the standby position to a ready-to-fold position, where the one of the cardboard boxes abuts against said support surface of said support group.

2. The feeding device for a box folding machine as claimed in claim 1, wherein:

said at least one pushing group of said box pushing unit includes a linking block connected to said mounting seat, two pins, each of said pins extending movably along the first horizontal direction through said linking block with an end segment thereof protruding out of said linking block, two resilient members sleeved respectively on said end segments of said pins, and a push component having a contact board that is spaced apart from said linking block and that is connected co-movably to said end segments of said pins, each of said resilient members having opposite ends that abut respectively against said linking block and said contact board for biasing said contact board away from said linking block, said contact board having a slanted end portion, and a pusher that is connected to an end of said contact board opposite to said slanted end portion of said contact board; and when the one of the cardboard boxes is at the standby position, the movement of said at least one pushing group along the vertical direction moves said contact board of said push component to be in contact with the one of the cardboard boxes under guidance of said slanted end portion of said contact board, and moves said pusher to abut against the one of cardboard boxes.

3. The feeding device for a box folding machine as claimed in claim 1, wherein said support group of said base unit includes:

a support seat having said support surface, and being movable along directions parallel to the vertical direction relative to said machine body; and a seat adjustment driver connected to said support seat for driving movement of said support seat parallel to the vertical direction relative to said machine body.

4. The feeding device for a box folding machine as claimed in claim 3, wherein said seat adjustment driver of said support group includes:

a drive shaft that extends transversely to the vertical direction, and that is rotatably mounted to said machine body;

two parallel threaded shafts that extend along the vertical direction, and that are rotatably mounted to said machine body;

a bevel gear group that is mounted between said drive shaft and one of said threaded shafts for transferring rotation of said drive shaft to rotation of said one of said threaded shafts;

a transmission gear group that is mounted between said threaded shafts for transferring rotation of said one of said threaded rods to the other one of said threaded shafts such that said threaded shafts rotate at the same speed; and two nut pieces that are connected to said support seat, each of said nut pieces being threadedly and movably engaged with a respective one of said threaded shafts such that, when said threaded shafts rotate, said nut pieces and said support seat move collectively along the directions parallel to the vertical direction relative to said machine body.

5. The feeding device for a box folding machine as claimed in claim 1, wherein said base unit further includes a vacuum suction member mounted to said machine body between said support surface and said top surface of said machine body, being exposed from said side surface, and adapted for pulling the one of the cardboard boxes against said side surface via negative pressure when the one of the cardboard boxes is at the ready-to-fold position.

6. The feeding device for a box folding machine as claimed in claim 1, wherein said positioning unit further includes:

two blocking members that are mounted rotatably to said downstream end of said machine body, that are spaced apart in the second horizontal direction, and that are adapted to be pushed by the one of the cardboard boxes to rotate during rotation of said stopping members from the stopping position to the releasing position, such that said stopping members, said blocking members and the remainder of the cardboard boxes cooperatively hold the one of the cardboard boxes to be perpendicular to the first horizontal direction at the standby position; and two second springs, each of said second springs being connected between a respective one of said blocking members and said machine body, and being adapted to bias said respective one of said blocking members against the one of the cardboard boxes.

7. The feeding device for a box folding machine as claimed in claim 6, further comprising a sensor unit that is mounted to said machine body, and that includes:

two first sensors disposed respectively adjacent to said stopping members for sensing movements of said stopping members; and two second sensors disposed respectively adjacent to said blocking members for sensing movements of said blocking members, and adapted to cooperate with said first sensors to determine if the one of the cardboard boxes is perpendicular to the first horizontal direction at the standby position.

8. The feeding device for a box folding machine as claimed in claim 1, further comprising an assisting unit mounted to said downstream end of said machine body, and including two assisting pushers that are spaced apart along the second horizontal direction, each of said assisting pushers including:

a push rod that extends along the first horizontal direction;

a push block that is movably coupled to said push rod; and a push spring sleeved on said push rod, and adapted for biasing said push block to support the one of the cardboard boxes during the movement of the one of the cardboard boxes from the standby position to the ready-to-fold position.

* * * * *